US005308676A

United States Patent [19]

Gelles et al.

[11] Patent Number: 5,308,676

[45] Date of Patent: May 3, 1994

[54] TORCHABLE ROLL ROOFING MEMBRANE

[75] Inventors: Richard Gelles; Mark A. Berggren, both of Houston; Dennis W. Gilmore, Katy, all of Tex.

[73] Assignee: Shell Oil Company, Houston, Tex.

[21] Appl. No.: 763,463

[22] Filed: Sep. 20, 1991

[51] Int. Cl.[5] ..... B32B 7/04

[52] U.S. Cl. ..... 428/141; 427/138; 427/389.8; 427/389.9; 427/407.2; 427/407.3; 427/412; 428/145; 428/171; 428/213; 428/228; 428/247; 428/489

[58] Field of Search ..... 428/141, 145, 171, 213, 428/228, 247, 489, 138, 407.2, 407.3, 412, 389.8, 389.9

[56] References Cited

U.S. PATENT DOCUMENTS

| | | | |
|---|---|---|---|
| Re. 27,145 | 6/1971 | Jones | 260/880 |
| 3,345,316 | 10/1967 | Nielsen | 260/28.5 |
| 3,978,014 | 8/1976 | van Beem et al. | 260/28.5 |
| 4,032,491 | 6/1977 | Schoenke | 428/489 |
| 4,172,061 | 10/1979 | Bresson | 260/28.5 |
| 4,196,115 | 4/1980 | Bresson | 260/28.5 |
| 4,282,127 | 8/1981 | Desgouilles | 260/28.5 |
| 4,368,228 | 1/1983 | Gorgati | 428/110 |
| 4,405,680 | 9/1983 | Hansen | 428/285 |
| 4,412,019 | 10/1983 | Kraus | 524/71 |
| 4,485,144 | 11/1984 | Uffner et al. | 428/343 |
| 4,490,493 | 12/1984 | Mikols | 524/68 |
| 4,503,176 | 3/1985 | Barlow et al. | 524/62 |
| 4,636,414 | 1/1987 | Tajima et al. | 428/40 |
| 4,835,199 | 5/1989 | Futamura et al. | 524/66 |
| 5,036,119 | 7/1991 | Berggren | 523/351 |
| 5,051,457 | 9/1991 | Gelles | 524/68 |

FOREIGN PATENT DOCUMENTS

| | | |
|---|---|---|
| 740027 | 8/1966 | Australia . |
| 1258209 | 8/1989 | Canada . |
| 0234615 | 9/1987 | European Pat. Off. . |
| 0280357 | 8/1988 | European Pat. Off. . |
| 0285865-A2 | 10/1988 | European Pat. Off. . |
| 3342560 | 6/1985 | Fed. Rep. of Germany . |
| 63-268766 | 11/1988 | Japan . |
| 01-101371 | 4/1989 | Japan . |
| 1263109 | 10/1989 | Japan . |
| 8901618 | 6/1989 | Netherlands . |
| 1143895 | 2/1968 | United Kingdom . |
| 1329298 | 11/1970 | United Kingdom . |
| 1279644 | 6/1972 | United Kingdom . |
| 1284726 | 8/1972 | United Kingdom . |
| 1440011 | 6/1976 | United Kingdom . |

*Primary Examiner*—Paul J. Thibodeau
*Assistant Examiner*—H. Thi Lê
*Attorney, Agent, or Firm*—Donald F. Haas

[57] ABSTRACT

A torchable roll roofing membrane which comprises a reinforcing mat which is saturated and coated with bituminous composition comprising a bituminous component and, optionally, an unhydrogenated block copolymer of a monoalkenyl aromatic hydrocarbon and a conjugated diolefin, and coated onto one surface, a bituminous composition comprising a bituminous component and a hydrogenated block copolymer of a monalkenyl aromatic hydrocarbon and a conjugated diolefin.

10 Claims, No Drawings

TORCHABLE ROLL ROOFING MEMBRANE

BACKGROUND OF THE INVENTION

Asphalt is a common material utilized for the preparation of roofing members and coatings which may be applied as mopping grade asphalts, cutbacks in solvents, single ply membranes, shingles, roll roofing membranes, etc. While the material is suitable in many respects, in inherently is deficient in some physical properties which it would be highly desirable to improve. Efforts have been made in this direction by addition of certain conjugated diene rubbers, neoprene, resins, fillers and other materials for the modification of one or more of the physical properties of the asphalt binder. Each of these added materials modifies the asphalt in one respect or another but certain deficiencies can be noted in all compounds proposed. For example, some of them have excellent weather resistance, sealing and bonding properties but are often deficient with respect to warm tack, modulus, hardness and other physical properties.

Since the late 1960s, styrene-butadiene rubber and styrene-rubber block copolymers such as styrene-butadiene-styrene and styrene-isoprene-styrene block copolymers have been used to dramatically improve the thermal and mechanical properties of asphalts. Practical application of the rubber addition approach requires that the blended product retain improved properties and homogenity during transportation, storage and processing. Long term performance of elastomer-modified asphalts also depends on the ability of the blend to maintain thermal and chemical stability.

To be suitable for synthetic roofing materials, the asphalt-block copolymer mixtures should meet the following requirements:

(a) sufficient resistance to flow at high temperatures, (b) sufficient flexibility at low temperatures, (c) workability according to the conventional methods used in the roofing technique, (d) adequate hot storage stability, (e) adequate hardness to prevent deformation during walking on the roof, and (f) if it is to be used as an adhesive, sufficient adhesion.

For roll roofing applications, it is preferred that the softening point (the temperature at which the material will tend to flow) be above about 250° F., the cold bend temperature (the temperature at which the material will crack during application and service), which is not as critical a parameter as the others in this application, should be below about −5° C. and that the asphalt and block copolymer components should be able to be mixed and processed at a temperature no higher than about 200° C. to keep the asphalt heating costs down and to prevent softening of the polyester reinforcement commonly used in these membranes.

For roll roofing membranes, the bituminous composition is used to saturate and coat a reinforcing mat. The bitumen is there to make the membrane waterproof. The mat is used to aid in mechanical properties (gives the membrane strength etc.). Polymer is added to the asphalt to improve the weatherability and mechanical properties of the asphalt.

Until recently, only unhydrogenated block copolymers were being used in roll roofing applications. For instance, a linear unhydrogenated styrene-butadiene-styrene block copolymer with a total molecular weight of 110,000 and a polystyrene content of 31% could be used for such applications. When 12% of this block copolymer is used with AC-10 blend asphalt (defined later in the examples), the softening point is about 230° F., the cold bend temperature is about −25° C. and the components can be mixed at a temperature of approximately 160°-180° C. Another unhydrogenated block copolymer, a coupled radial styrene-butadiene block copolymer with a total molecular weight of 264,000 and a polystyrene content of 31%, could also be used in such applications. When blended with the same asphalt at the same concentration, the softening point is approximately 262° F., the cold bend temperature is approximately −25° C. and the components can be mixed at approximately 180°-200° C. Unhydrogenated block copolymers have certain disadvantages which can cause problems when used in applications such as these. Such disadvantages include poor stability of the block copolymer during blending and storage of the bituminous composition and poor long term stability when the bituminous composition is exposed to the elements (by stability we mean resistance to degradation) or heat.

Resistance to degradation under the application of heat is an important consideration in materials for roll roofing membranes. Roll roofing membranes are used, for example, to protect the surface of a roof. The membrane is rolled up and when applied, is merely unrolled in place on the roof. A roll roofing membrane is comprised of a reinforcing mat saturated and coated with asphaltic compositions which may contain a modifying polymer. One application method to secure the membrane to the roof is torching, i.e. heating with a flame at a high temperature, perhaps close to 2000° C. Unhydrogenated block copolymers have a tendency to degrade when exposed to such extreme heat making them less desirable for this application.

High performance roll roofing membranes which comprise a reinforcing mat coated with nonhydrogenated block copolymer modified asphalt can be overtorched. Excessive torching can cause substantial polymer degradation. This can cause a layer of polymer modified asphalt with poor high temperature flow resistance. In other words, it could contribute to roof failure by slippage of the membrane.

It is now known that saturated block copolymers are useful to modify asphalt in roofing applications. For example, copending, commonly assigned U.S. patent application Ser. No. 553,042, filed Jul. 16, 1990, now U.S. Pat. No. 5,051,457, describes a composition for use in roll roofing membrane applications. The composition comprises about 93 to about 87 parts per hundred of a bituminous component having a penetration of less than about 125 (decamillimeters) at 25° C. and from about 7 to about 13 parts per hundred of a hydrogenated block copolymer of a monoalkenyl aromatic hydrocarbon and a conjugated diolefin having a contour arm a molecular weight before hydrogenation of from about 105,000 to about 140,00 and a polystyrene content of from about 25% to about 37%.

The saturated or hydrogenated block copolymers are more expensive than their unsaturated or unhydrogenated counterparts. Therefore, it would be more expensive to utilize hydrogenated block copolymers throughout the asphaltic composition which saturates and coats the reinforcing mat of the roll roofing membrane. Thus, there is a need for a way to protect the roll roofing membrane from polymer degradation without having to utilize a large amount of the higher cost saturated polymer.

SUMMARY OF THE INVENTION

The present invention provides an improved roll roofing membrane which has the advantage of increased resistance to degradation through the influence of heat and which is more economical than utilizing saturated polymers throughout the membrane. A roll roofing membrane is prepared in the normal way and is saturated with a first bituminous composition which can be an asphalt modified with an unsaturated polymer. A thin protective layer of a blend of asphalt and a saturated polymer makes up the second bituminous composition which is coated onto the surface of the membrane which will be exposed to heat (torched) when the membrane is to be installed on a roof.

DETAILED DESCRIPTION OF THE INVENTION

The basic part or framework of a roll roofing membrane in the reinforcing mat. The reinforcing mat is made of a material which is capable of being saturated and coated with bituminous compositions which can be polymer modified asphalt or some other material such as unmodified asphalt. Such materials include fibrous materials including glass and polyester fibers. The reinforcing mat is saturated and coated with a bituminous composition. The bituminous compositions used to saturate and coat the mat may be different. The composition used to saturate sometimes is not modified with polymer. The roll roofing membrane may or may not be topped with granules. In order to make the roll roofing membrane of the present invention, a thin layer of a bituminous composition containing the hydrogenated block copolymer is coated onto one surface of the membrane to form a protective layer. This is the surface which will be exposed to the heat when the roll roofing membrane is torched as it is applied on the surface of a roof. This thin layer generally is from about 5 to about 150 mils in thickness. A plastic cover sheet may be placed over the top of the thin layer to prevent the membrane from adhering to itself. The plastic sheet generally burns off during torching.

The bituminous component in the bituminous-block copolymer compositions according to the present invention may be a naturally occurring bitumen or derived from a mineral oil. Also petroleum derivatives obtained by a cracking process and cold tar can be used as the bituminous component as well as blends of various bituminous materials.

Examples of suitable components include distillation or "straight-run bitumens", precipitation bitumens, e.g. propane bitumens, blown bitumens and mixtures thereof. Other suitable bituminous components include mixtures of one or more of these bitumens with extenders such as petroleum extracts, e.g. aromatic extracts, distillates or residues. Suitable bituminous components (either "straight-run bitumens" or "fluxed bitumens") include those having a penetration of less than about 125 (decamillimeters) at 25° C. This limitation excludes many of the softer bituminous components such as pure fluxes and pure aromatic extracts which are too tacky for this application. In addition, their use requires high levels of high molecular weight block copolymer to meet softening point requirements, which is expensive However, softer asphalts can be used when a filler is used as described in copending, commonly assigned U.S. patent application Ser. No. 705,448, filed May 24, 1991, abandoned (incorporated herein by reference) because the filler makes the composition harder and less tacky. The amount of block copolymer component used in the compositions for saturating and coating the reinforcing mat range generally from about 0 to about 20 parts per hundred, preferably from about 9 to about 15 parts per hundred (note that the saturant may not contain any polymer although the coating will always contain some polymer). Negatives at higher polymer loadings include difficulties blending and processing due to high viscosities.

The block copolymer components of the compositions saturating and coating the reinforcing mat are block copolymers of a monoalkenyl aromatic hydrocarbon such as styrene and a conjugated diolefin such as butadiene or isoprene. The block copolymer used in the coating or protective layer on one side or both sides of the membrane is hydrogenated. If used at all, the block copolymer in the saturating bituminous composition is not hydrogenated. Such elastomeric block copolymers can have general formulas A-B-A or $(AB)_nX$ wherein each A block is a monoalkenyl aromatic hydrocarbon polymer block, each B block is a conjugated diolefin polymer block, X is a coupling agent, and n is an integer from 2-30. Such block copolymers may be linear or may have a radial or star configuration as well as being tapered. Block copolymers such as these are well known and are described in many patents including U.S. Pat. Nos. 4,145,298, 4,238,202 and 27,145 which describes hydrogenated block copolymers containing butadiene. These patents are herein incorporated by reference. The description of the type of polymers, the method of manufacturing the polymers and the method of hydrogenation of the polymers is described therein and is applicable to the production of block copolymer containing other alkenyl aromatic hydrocarbons and other conjugated diolefins such as isoprene or mixtures of conjugated diolefins.

The hydrogenated block polymers used in the present invention are blended with the same bituminous components described above. Generally, the hydrogenated block copolymers are used in an amount from about 3 to about 15 parts per hundred of the total bituminous composition used for coating and protecting one or both sides of the main membrane. Greater than about 3 parts per hundred are required so that the coating resists flow when in place on the roof but is still flexible during application. Less than about 15 parts per hundred is required due to cost, processability during coating and so that flow takes place easily during torching. Other polymers may be included in the bituminous composition provided they are of low crystallinity and are also resistant to torching, i.e., are saturated or close to completely saturated. Examples of such polymers are atactic polypropylene homopolymers and copolymers, extremely low density polyethylenes, ethylene propylene rubbers and the like. It is preferable that the bituminous component comprise at least about 60 parts per hundred of the bituminous composition which contains the hydrogenated block copolymer because of cost, the need for tackiness after torching to make the bond to the roof and to lower viscosity during manufacturing.

The molecular weights of the unhydrogenated and hydrogenated block copolymers used in the present invention may vary over a wide range. However, it is preferable that the contour arm molecular weight of the unhydrogenated and hydrogenated block copolymers range from about 30,000 to about 300,000. At lower molecular weights, they must be added at high concentrations and at higher molecular weights, they are expensive and give compositions that are difficult to process. These molecular weights are determined by gel permeation chromatography.

The molecular weight ranges referred to herein are the contour arm molecular weights. Radial and star polymers have much higher total molecular weight than linear polymers do but the mechanical properties considered herein are dependent not upon the total molecular weight in the case of radial and star polymers but rather on the molecular weight of the contour arms of those polymers. For a linear A-B-A polymer, the contour molecular weight is the same as the total molecular weight and the molecular weight range of the present invention is 30,000 to 300,000 for linear polymers. For three arm radial polymers, one must multiply the contour arm molecular weight by 1.5 to obtain the total molecular weight. Thus, the total molecular weight range for a three arm polymer of the present invention would be 45,000 to 450,000. For a four arm radial polymer, the range would be two times the contour molecular weight range or 60,000 to 600,000. In general, for a coupled radial or star polymer $(AB)_nX$, the contour molecular weight is the molecular weight along the contour of the molecule, which is $(AB)_2$. Thus, for a coupled radial or star polymer $(AB)_nX$, the total molecular weight range is n/2 times the contour molecular weight range.

In order to be effective in the present application, the unhydrogenated and hydrogenated block polymers generally have a polystyrene content ranging from about 20% to about 37%. If the polystyrene content is lower than about 20%, the physical properties are decreased and the molecular weight of the polymer would have to be much higher to get the proper physical properties and increasing the molecular weight may cause mixing problems. It also increases the cost of the polymer. If the polystrene content is above about 37%, the bituminous component and the block polymer component are generally too hard to mix. The elastomeric properties tend to decrease because of the presence of a continuous styrene phase in the polymer.

The compositions of the present invention may contain other materials such as fillers including calcium carbonate, limestone, chalk, ground rubber tires, etc. Other materials which may be incorporated in these composition include unsaturated block copolymers like SBS or SIS, etc. If other materials are added, the relative amounts of the bitumen and polymer specified above remain the same.

The bituminous block copolymer compositions of the present invention may be prepared by various methods. A convenient method comprises blending of the two components at an elevated temperature, preferably not more than about 250° C. to keep the asphalt heating costs down. Other methods for preparing the composition of the present invention include precipitation or drying of the components from a common solvent and emulsifying the polymer with an asphalt emulsion.

EXAMPLES

Blends of asphalt and block copolymer were prepared using a laboratory Silverson high shear mixer. An appropriate amount of asphalt was heated in a quart can in an oven at 160° C. for 45 minutes. The quart can was then placed in a heating mantel and, with heat and stirring, its temperature was raised to the mixing temperature. The polymer was then added slowly. Mixing was completed after the homogenity of the mixture (judged visually) did not change for 15 minutes. To determine the mixing temperature used, an experiment was first performed in the following manner: the asphalt temperature was first set at 180° C. and the polymer was added. If it did not start to mix after 10 minutes, the temperature was raised 5° C. This was repeated until the initial temperature at which the polymer began to mix was determined.

The softening point measurements utilized herein were determined by ASTM D36. The penetration of the asphalts used herein was determined by ASTM D5.

EXAMPLE 1

Hydrogenated block copolymers are more stable than nonhydrogenated block copolymers and so resist degradation during torching 3" long×1" wide×0.1" thick samples of three (3) polymer modified asphalts were torched with a hand held propane torch. The three samples were a 9% blend of an unhydrogenated coupled radial styrene-butadiene block copolymer with a total molecular weight of 264,000 and a polystyrene content of 31% in Martinez AR-1000 asphalt, a 12% blend of a hydrogenated sequentially polymerized styrene-butadiene-styrene block copolymer with a total molecular weight and polystyrene content prior to hydrogenation of 61,000 and 29% respectively in Martinez AR-1000 asphalt, and a polypropylene/Martinez AR-2000 asphalt blend. The latter contained 7% atactic polypropylene copolymer, 14% atactic polypropylene homopolymer and 5% isotactic polypropylene. Martinez AR-1000 is a soft asphalt very compatible with block copolymers. It has a softening point of 102° F. and a 25° C. pen measured at 100 gm, 5 sec of 117 dmm. Martinez AR-2000 is a stiffer asphalt from the same crude source. Its properties were not measured.

Roofing contractors often torch polypropylene modified roll roofing until a flowing head of molten modified asphalt is formed. There is a concern with nonhydrogenated block copolymer modified asphaltic roll roofing in that if contractors torch it the way they torch polypropylene modifieds, polymer degradation will take place.

The hand held propane flame was adjusted so that the blue flame cone was one inch long. The samples were laid on a horizontal surface. The torch was held horizontally during torching. This resulted in a thirty degree angle formed between the flame and the horizontal surface.

The three samples were torched until molten beads began to form and flow. This took seven seconds for the polypropylene modified and five seconds for both block copolymer modifieds. Samples from the top 0.05" thickness of the torched block copolymer modifieds were analyzed for polymer degradation by GPC. The samples from the nonhydrogenated block copolymer modifieds showed 40% degradation as measured by loss of the main peak species. The samples from the hydrogenated block copolymer modified showed less than 1% degradation.

EXAMPLE 2

Hydrogenated block copolymer modifieds are easy to torch and give strong laps

There is a misperception in the roofing industry that block copolymer modifieds require more heat than polypropylene modifieds during torching (longer times) to prepare good laps (ones with strength). This may be because, although block copolymer modifieds can become glossy and then bead and flow as fast or faster than polypropylene modifieds, polypropylene modifieds typically flow more. The following examples were carried out to show that block copolymer modifieds do not require any more heat to prepare good laps.

The three systems examined were all made with Wood River AC-10 asphalt. The asphalt has a softening point of 117° F. and a pen of 93 dmm. It is representative of "semi-compatible" asphalts used in roll roofing. Such asphalts are often used because they give products with better flow resistance, a better high temperature "walkability" and better handling characteristics due to low tack. However, softer more compatible asphalts can be used in roll roofing. For example, they can be more highly filled to solve the tack and walkability problems.

The atactic polypropylene (APP) blend was made with 20% APP homopolymer D-7682-138 from Eastman. The hydrogenated block copolymer modified blend contained 12% of the hydrogenated block copolymer used in Example 1. The nonhydrogenated block copolymer modified blend contained 12% of the nonhydrogenated block copolymer used in Example 1.

Samples 2½" long×1" wide×0.125" thick were adhered to 4 mil thick aluminum foil. Identical samples with a release paper stuck to them in such a way to leave a 1"×1" exposed area were used for the top half of the lap. The bottom samples were torched in the manner of example 1 for various times. The top sample was then placed on top of the bottom sample to make the lap. A 1"×2"×3" 225 gm concrete block was then placed on top of the lap for ten seconds. The samples were allowed to cool and were tested eighteen hours later. 180° peel testing of the laps were carried out on an Instron tensile tester with a grip separation rate of 10"/minute. The maximum stress measured is reported in pounds per linear inch of bond (pli). Results, which are the average of three measurements, are shown in Table 1. Clearly, block copolymer modifieds do not require longer torching times than polypropylene modifieds. In addition, laps made with the hydrogenated block copolymer modifieds are the strongest.

TABLE 1

| | 180 Degree Peels of Torched Laps (PLI) | | |
|---|---|---|---|
| Torching Time (Sec) | Unhydrogenated Block Copolymer | Hydrogenated Block Copolymer | APP |
| 0.5 | 3.7 | 1.3 | 3.2 |
| 1.0 | 12.1 | 11.3 | 9.3 |
| 2.5 | 14.5 | 21.8 | 12.3 |

TABLE 1-continued

| | 180 Degree Peels of Torched Laps (PLI) | | |
|---|---|---|---|
| Torching Time (Sec) | Unhydrogenated Block Copolymer | Hydrogenated Block Copolymer | APP |
| 4.0 | 14.3 | 28.9 | 14.2 |
| 5.5 | 16.5 | 30.2 | 16.3 |
| 6.0 | 15.0 | 16.5 | 19 |
| 6.5 | 16.8 | 24.5 | 19 |

We claim:

1. A torchable roll roofing membrane which comprises a reinforcing mat which is saturated with a first bituminous composition comprising a bituminous component and from 9 to 15 parts of an unhydrogenated block copolymer of a monoalkenyl aromatic hydrocarbon and a conjugated diolefin per 100 parts of said first bituminous composition, a second bituminous composition comprising a bituminous component and from 3 to 15 parts per hundred of the total bituminous composition of a hydrogenated block copolymer of a monoalkenyl aromatic hydrocarbon and a conjugated diolefin.

2. The membrane of claim 1 wherein the coating layer of the second bituminous composition is from 5 to 150 mils in thickness.

3. The membrane of claim 1 wherein the polystyrene content of the unhydrogenated and hydrogenated block copolymers ranges from 20% to 37%.

4. The membrane of claim 1 wherein the reinforcing mat is made of a material which is capable of being saturated and coated with bituminous compositions.

5. The membrane of claim 6 wherein the material of the reinforcing mat is selected from the group consisting of glass and polyester fibers.

6. A method of making a torchable roll roofing membrane which comprises saturating a reinforcing mat with a first bituminous composition comprising a bituminous component and from 9 to 15 parts of an unhydrogenated block copolymer of a monoalkenyl aromatic hydrocarbon and a conjugated diolefin per 100 parts of said first bituminous composition, a second bituminous composition comprising a bituminous component and from 3 to 15 parts per hundred of the total bituminous composition of a hydrogenated block copolymer of a monoalkenyl aromatic hydrocarbon and a conjugated diolefin.

7. The process of claim 6 wherein the coating layer of the second bituminous composition is from 5 to 150 mils in thickness.

8. The process of claim 6 wherein the polystyrene content of the unhydrogenated and hydrogenated block copolymers ranges from 20% to 37%.

9. The process of claim 6 wherein the reinforcing mat is made of a material which is capable of being saturated and coated with bituminous compositions.

10. The process of claim 9 wherein the material of the reinforcing mat is selected from the group consisting of glass and polyester fibers.

* * * * *